US006724295B2

(12) United States Patent
Tsukada

(10) Patent No.: US 6,724,295 B2
(45) Date of Patent: Apr. 20, 2004

(54) CHIP RESISTOR WITH UPPER ELECTRODE HAVING NONUNIFORM THICKNESS AND METHOD OF MAKING THE RESISTOR

(75) Inventor: Torayuki Tsukada, Kyoto (JP)

(73) Assignee: Rohm Co., Ltd., Kyoto (JP)

( * ) Notice: Subject to any disclaimer, the term of this patent is extended or adjusted under 35 U.S.C. 154(b) by 0 days.

(21) Appl. No.: 10/092,257

(22) Filed: Mar. 7, 2002

(65) Prior Publication Data

US 2002/0130761 A1 Sep. 19, 2002

(30) Foreign Application Priority Data

Mar. 9, 2001 (JP) ..... 2001-066291

(51) Int. Cl.[7] ..... H01C 1/012

(52) U.S. Cl. ..... 338/309; 338/313; 338/314; 338/328; 338/332

(58) Field of Search ..... 338/307, 308, 338/309, 313, 314, 328, 332

(56) References Cited

U.S. PATENT DOCUMENTS 5,379,016 A * 1/1995 Smith et al. ..... 338/309
5,966,067 A * 10/1999 Murakami et al. ..... 338/309
6,153,256 A 11/2000 Kambara et al.
6,242,999 B1 * 6/2001 Nakayama et al. ..... 338/309
6,304,167 B1 * 10/2001 Nakayama ..... 338/195

* cited by examiner

*Primary Examiner*—Karl D. Easthom
(74) *Attorney, Agent, or Firm*—Michael D. Bednarek; Shaw Pittman LLP

(57) ABSTRACT

A method of making a chip resistor is provided. According to this method, an aggregate board is first prepared which includes a first region and a second region which are spaced from each other via an excess portion. Then, a conductor pattern is formed which extends to bridge the first region and the second region. Subsequently, a resistor element is formed in each of the first region and the second region for connection to the conductor pattern. Then, the aggregate board is cut at the excess portion. The conductor pattern includes a thinner-walled portion extending across the excess portion and a thicker-walled portion connected to the thinner-walled portion and spaced from the excess portion.

3 Claims, 14 Drawing Sheets

CHIP RESISTOR WITH UPPER ELECTRODE HAVING NONUNIFORM THICKNESS AND METHOD OF MAKING THE RESISTOR

BACKGROUND OF THE INVENTION

1. Field of the Invention

The present invention relates to a chip resistor for surface-mounting on a printed circuit board and to a method of making the same.

2. Description of the Related Art

As is well known, various types of chip devices have been developed as components for constituting electric circuits. An example of such chip devices is a surface-mounting-type chip resistor (designated by a reference sign 21 as a whole) as shown in FIG. 15. The resistor 21 includes a rectangular substrate 22 formed of alumina ceramic material. As shown in FIG. 15, the substrate 22 has an upper surface 22*a*, side surfaces 22*b* and a lower surface 22*c*. The resistor 21 includes a pair of first upper electrodes 23 formed on the upper surface 22*a*, side electrodes 24 formed on the respective side surfaces 22*b*, and lower electrodes 25 formed on the lower surface 22*c*. The upper surface 22*a* of the substrate 22 is formed with a resistor element 26 connecting the first upper electrodes 23 to each other. The resistor element 26 is covered with a protective coating layer 27. Further, the protective coating layer 27 is covered with an overcoat layer 29. Each first upper electrode 23 has an upper surface formed with a second upper electrode 28.

The resistor 21 may be formed utilizing an aggregate board 11 as shown in FIG. 16, which is made of alumina ceramic material. The aggregate board 11 has a size capable of simultaneously providing a plurality of identical resistors. Specifically, the aggregate board 11 is sectioned into a plurality of rectangular regions 12. Each of the rectangular regions 12 corresponds to one resistor 21. In the figure, reference signs 13, 14 indicate excess portions of the aggregate board 11. The aggregate board 11 will be divided along the excess portions using a dicing cutter for example.

As shown in FIG. 16, the aggregate board 11 has an upper surface on which a plurality of conductor pieces 23' are arranged in a matrix. Each of the conductor pieces 23' extends across the corresponding cutting line 13. Each rectangular region 12 is overlapped by two conductor pieces 23' which are spaced from each other along a cutting line 14. The overlapping regions finally become the upper electrodes 23 shown in FIG. 15.

After the conductor pieces 23' are formed, necessary parts such as a resistor layer corresponding to the resistor element 26 (FIG. 15) and a protective coating layer and the like are formed. Then, at an appropriate stage, the aggregate board 11 together with the conductor pieces 23' and the like formed thereon are divided along the cutting lines (excess portions) 13.

Thereafter, side conductor layers (corresponding to the side electrodes 24 of FIG. 15) are formed on the cutting surface of the substrate 11. By subsequently dividing the substrate 11 along the cutting lines (excess portions) 14, the plural rectangular regions 12 are completely separated from each other. Finally, plating is applied to the electrodes 24, 25 and 28 shown in FIG. 15, thereby providing the resistor 21 as a final product.

Although the above method is capable of making a plurality of resistors from one aggregate board and hence has a high manufacturing efficiency, it also has the following drawbacks.

As described above, in the manufacturing process, the aggregate board 11 (and the conductor pieces 23' and the like) are divided along the cutting lines 13. At this time, the rotation of the dicing cutter may raise the conductor pieces 23'. In such a case, as shown in FIG. 17, the first upper electrode 23 of the resistor 21 includes a rising portion at the edge thereof. As a result, the second upper electrode 28 formed on the first upper electrode 23 also rises.

Such a rising portion formed in the resistor 21 causes various problems. For example, the side electrode 24 may not be suitably connected to the first upper electrode 23 or the second upper electrode 28. Further, in solder-plating the second upper electrode 28, solder cannot be suitably applied to the rising portion.

SUMMARY OF THE INVENTION

The present invention is conceived under the circumstances described above. It is, therefore, an object of the present invention is to provide a chip resistor which is free from the rising of an electrode on the supporting substrate.

According to a first aspect of the present invention, there is provided a method of making a chip resistor. This method includes the following steps. First, an aggregate board is prepared which includes a first region and a second region which are spaced from each other via an excess portion. Then, a conductor pattern is formed which extends to bridge the first region and the second region. Subsequently, a resistor element is formed in each of the first region and the second region for connection to the conductor pattern. Then, the aggregate board is cut at the excess portion. The conductor pattern includes a thinner-walled portion extending across the excess portion and a thicker-walled portion connected to the thinner-walled portion and spaced from the excess portion.

According to the above structure, the conductor pattern is cut together with the substrate. However, since the conductor pattern is cut at the thinner-walled portion, the problem of rising as is in the prior art does not occur. Preferably, the thinner-walled portion has a thickness of 0.1–3.0 $\mu$m, whereas the thicker-walled portion has a thickness of 5–25 $\mu$m.

Preferably, the conductor pattern forming step includes a sub-step of applying a conductor paste for the thicker-walled portion and a sub-step of applying a conductor paste for the thinner-walled portion.

Preferably, the conductor paste for the thicker-walled portion and the conductor paste for the thinner-walled portion are baked simultaneously.

Preferably, the conductor paste for the thicker-walled portion and the conductor paste for the thinner-walled portion are made of a same material.

Preferably, the method according to the present invention further comprises the step of forming a resistance adjusting groove in the resistor element.

According to a second aspect of the present invention, there is provided a chip resistor comprising an insulating substrate having an upper surface and a side surface, a first conductor pattern formed on the upper surface, a resistor element connected to the first conductor pattern. The first conductor pattern includes a thinner-walled portion contacting the upper surface, and a thicker-walled portion connected to the thinner-walled portion and contacting the upper surface. The thinner-walled portion is spaced from the resistor element and extends up to the side surface. The thicker-walled portion contacts the resistor element and is spaced from the side surface.

Preferably, the resistor further includes a second conductor pattern extending on the first conductor pattern. The second conductor pattern contacts both of the thinner-walled portion and the thicker-walled portion.

Preferably, the thinner-walled portion has a thickness of 0.1–3.0 μm, whereas the thicker-walled portion has a thickness of 5–25 μm.

Other features and advantages of the present invention will become clearer from the description of the preferred embodiment given below with reference to the accompanying drawings.

BRIEF DESCRIPTION OF THE DRAWINGS

FIGS. 3A–3B, 4A–4B, 5, 6A–6B and 7–13 illustrate the manufacturing process for the chip resistor of FIG. 1, wherein FIG. 3B is a sectional view taken along lines III—III of FIG. 3A, FIG. 4B is a sectional view taken along lines IV—IV of FIG. 4A, and FIG. 6B is a sectional view taken along lines VI—VI of FIG. 6A;

DETAILED DESCRIPTION OF THE PREFERRED EMBODIMENTS

Figure 1:
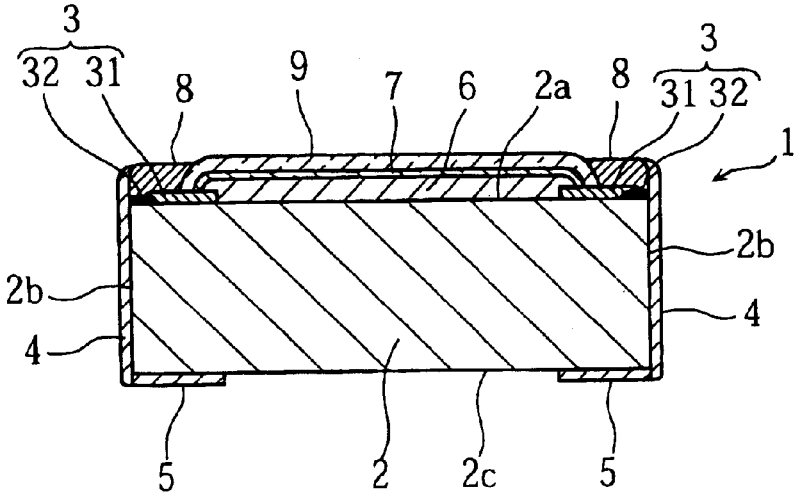
FIG. 1 is a sectional view illustrating the basic structure of a chip resistor according to the present invention.

FIG. 1 illustrates the basic structure of a chip resistor (designated by reference sign 1 as a whole) according to the present invention. The resistor 1 is in the form of a generally rectangular parallelepiped for surface-mounting on a printed circuit board (not shown).

The resistor 1 includes a substrate 2 made of alumina ceramic material. The substrate 2 has an upper surface 2*a* having opposite ends formed with first upper electrodes 3. Each of the first upper electrodes 3 is formed of a metal such as gold or silver and includes a thicker-walled portion 31 and a thinner-walled portion 32. The thicker-walled portion 31 is arranged as spaced from the upper edge of a respective side surface 2*b* of the substrate 2. The thinner-walled portion 32 adjoins the thicker-walled portion 31 and extends up to the side surface 2*b*. The thicker-walled portion 31 may have a thickness of 5–25 μm for example, whereas the thinner-walled portion 32 may have a thickness of 0.1–3.0 μm for example.

Each of the side surfaces 2*b* of the substrate 2 is formed with a side electrode 4 formed of gold or silver. The substrate 2 has a lower surface 2*c* formed with a pair of lower electrodes 5. The lower electrodes 5 are located at opposite ends of the lower surface 2*c* and spaced from each other. Each of the lower electrodes 5 is connected to the corresponding side electrode 4.

The upper surface 2*a* of the substrate 2 is formed with a resistor element 6 connected to the thicker-walled portions 31 of the first upper electrodes 3. The resistor element 6 is formed of a metal or a metal oxide having predetermined electric resistance characteristics. The resistor element 6 may be formed with a resistance adjusting groove (not shown) formed by trimming with a laser beam.

The resistor element 6 has an upper surface formed with a first coating layer 7 made of glass. The first coating layer 7 is formed to prevent the surface of the resistor element 6 from breaking due to the laser trimming.

The first coating layer 7 has an upper surface on which is formed a second coating layer 9 made of glass. The second coating layer 9 is provided for protecting the first coating layer 7.

Each first upper electrode 3 has an upper surface on which a second upper electrode 8 is formed for contact with a part of the second coating layer 9. The second upper electrode 8 is formed of resinated silver comprising silver particles contained in hardened resin. The second upper electrode 8 is provided for maintaining the electric characteristics of the first upper electrode 3. For facilitating the handling of the resistor 1 as a product, the second upper electrode 8 is made generally flush with the second coating layer 9. The second upper electrode 8 is connected to the side electrode 4. The second upper electrode 8, the side electrode 4, and the lower electrode 5 have outer surfaces covered with a nickel-plating layer or solder-plating layer (not shown).

Figure 2:
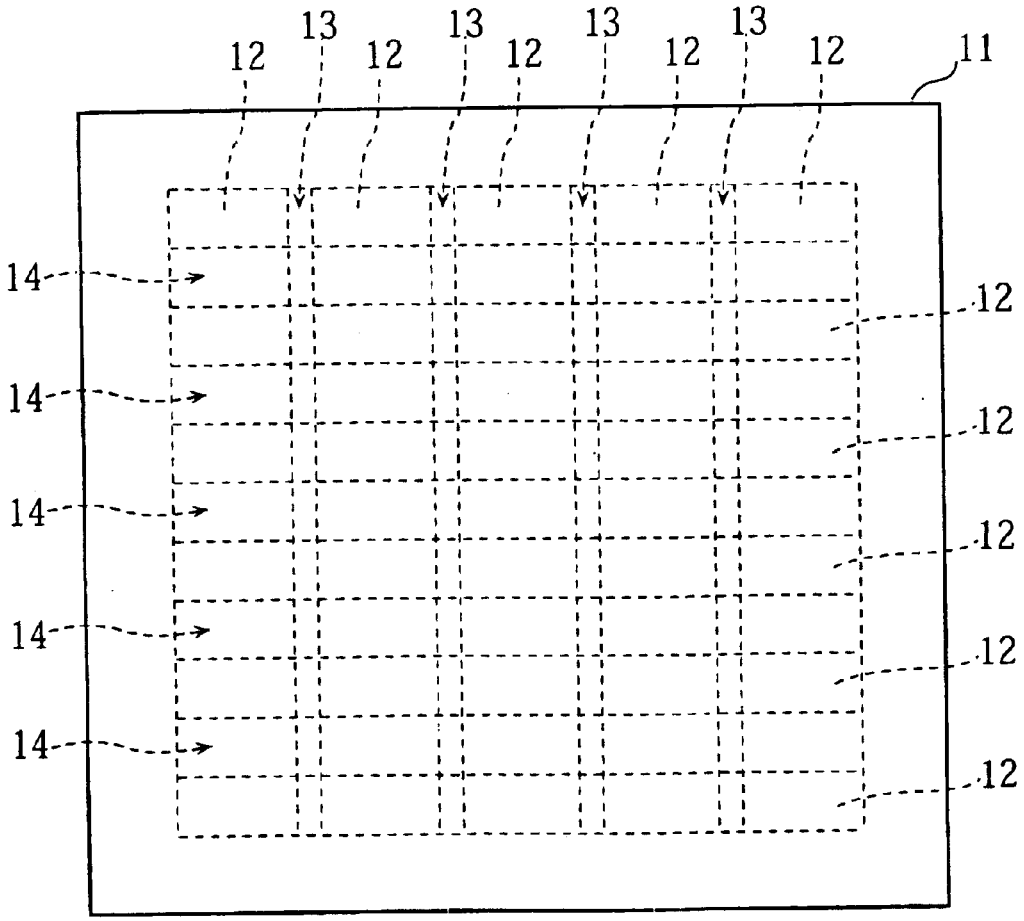
FIG. 2 is a plan view showing an aggregate board used for making the resistor of FIG. 1.

Referring to FIGS. 2–13 and 14, a process for manufacturing the resistor 1 will be described. First, an aggregate board 11 of alumina ceramic material is prepared, as shown in FIG. 2. The aggregate board 11 has a flat upper surface (shown in FIG. 12) and a flat reverse surface. The aggregate board 11 is obtained by cutting a green sheet into pieces of a predetermined size and then baking each cut piece. The aggregate board 11 includes rectangular regions 12 each of which corresponds to one resistor. Reference sign 13 designates excess portions which will be removed in cutting the aggregate board 11 vertically. Reference sign 14 designates excess portions which will be removed in cutting the aggregate board 11 horizontally. On the reverse surface of the aggregate board 11, a lower conductor pattern (not shown) is formed (S1 in FIG. 14). The conductor pattern corresponds to the lower electrodes 5 shown in FIG. 1. The lower conductor pattern may be formed by screen printing. Specifically, use may be made of a conductor paste prepared by dispersing minute metal particles (of gold or silver for example) and glass particles in an organic solvent. The lower conductor pattern may be formed by printing the conductor paste at predetermined portions and drying and baking the applied paste.

Figure 3A:
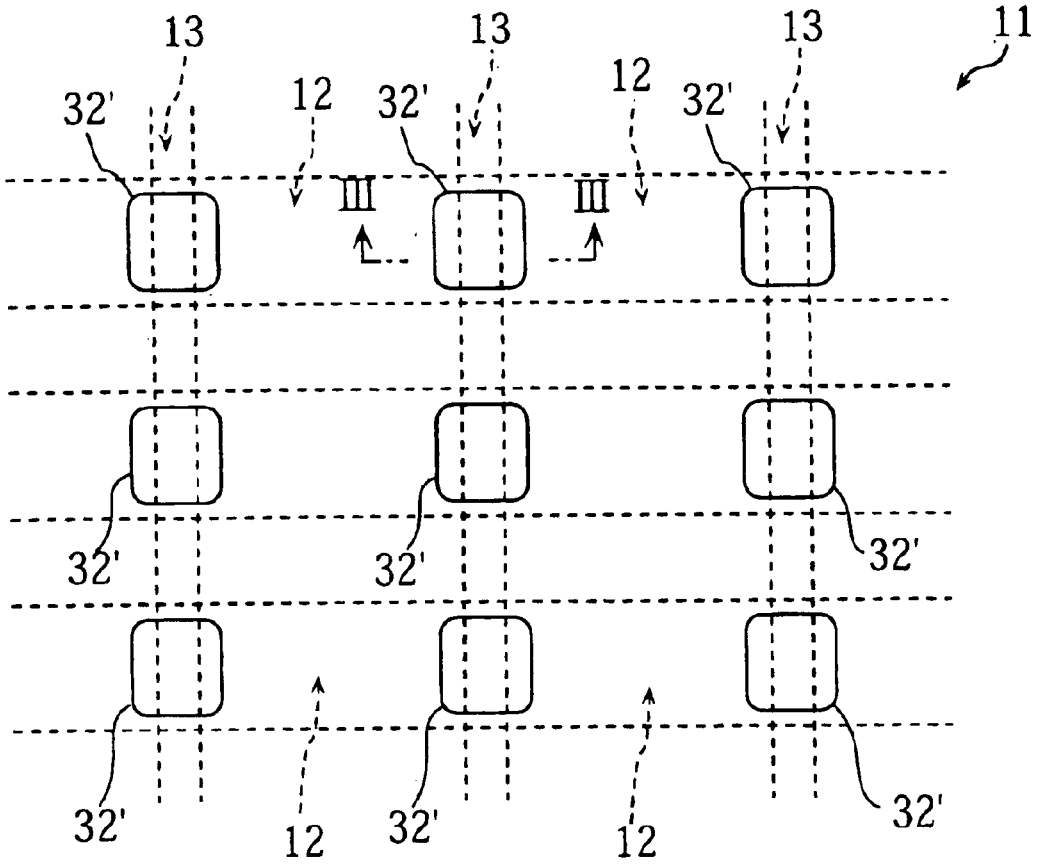
Figure 3B:
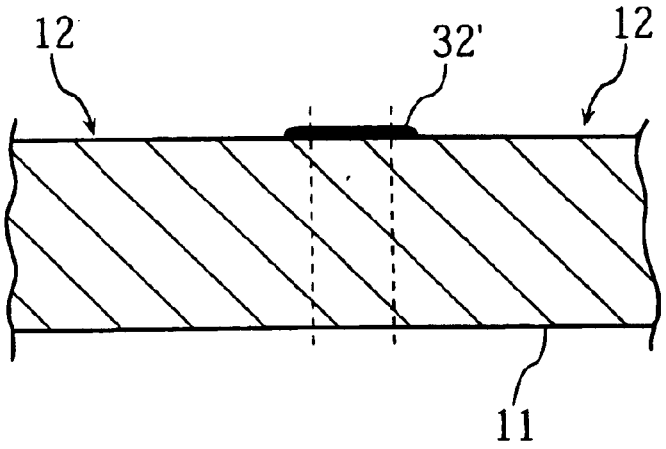

Subsequently, a first upper conductor pattern is formed on the upper surface of the aggregate board 11 (S2 in FIG. 14). Specifically, as shown in FIGS. 3A and 3B, conductor layers 32' of a smaller thickness are first formed. As shown in FIG. 3A, each of the conductor layers 32' is rectangular and extends to traverse the excess portion 13. The conductor layer 32' is in a range of 0.1–3.0 μm and preferably 2 μm in thickness. The conductor layer 32' may be formed by screen printing using a conductor paste containing gold (or silver) and glass.

Figure 4A:
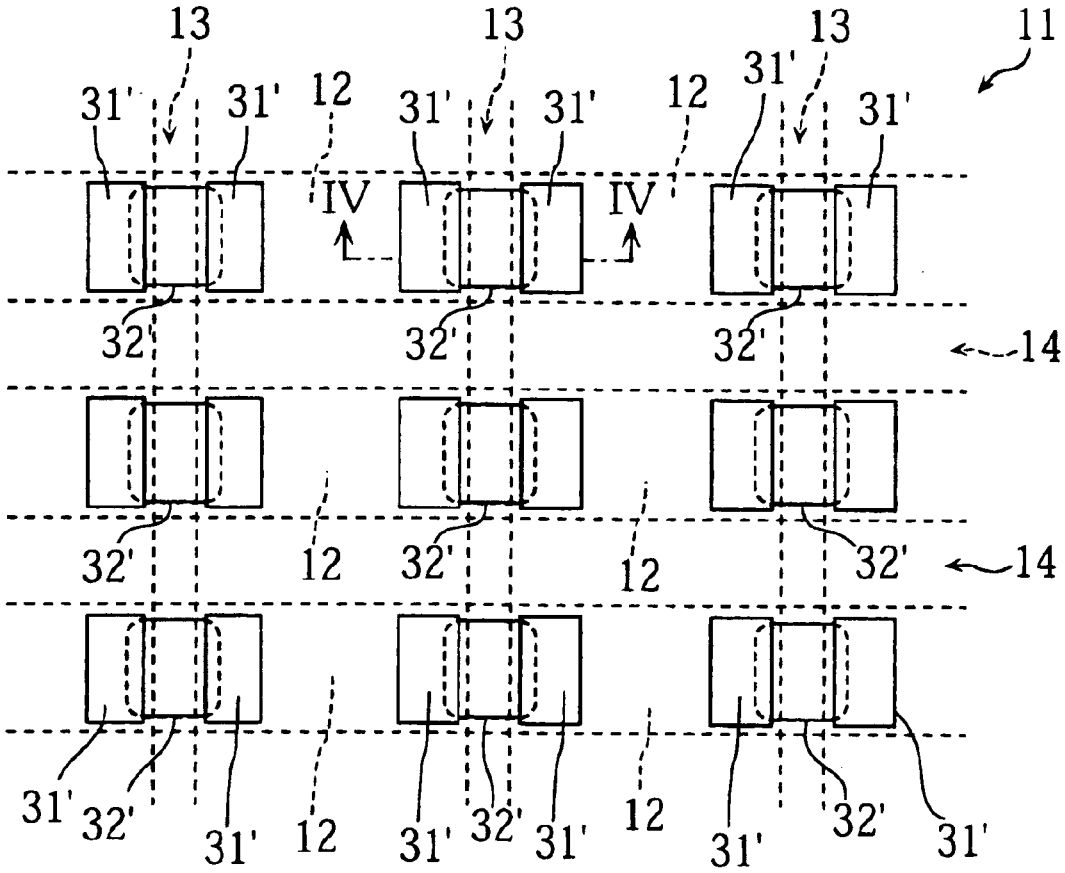
Figure 4B:
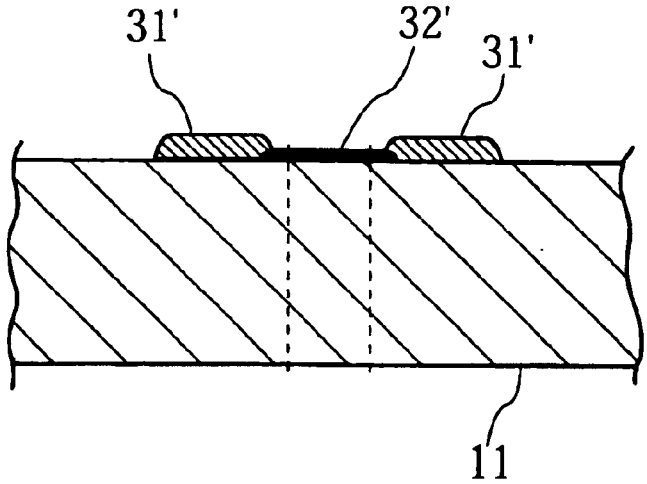

Then, as shown in FIGS. 4A and 4B, conductor layers 31' which are thicker than the conductor layers 32' are formed. The conductor layers 31' have a thickness of 5–25 μm and electrically connected to the conductor layers 32'. The conductor layers 31' may also be formed by screen printing using conductor paste containing gold (or silver) and glass. The formation of the conductor layers 31' and 32' from the same material is advantageous for providing reliable connection between these conductor layers. According to the present invention, however, the conductor layers 31' and 32' may be formed of different kinds of conductor paste.

Preferably, the conductor paste applied for forming the conductor layers 31' and 32' may be baked simultaneously.

This is advantageous for shortening the manufacturing time. The baking may be performed at 870° C. for 30 minutes, for example.

Figure 5:
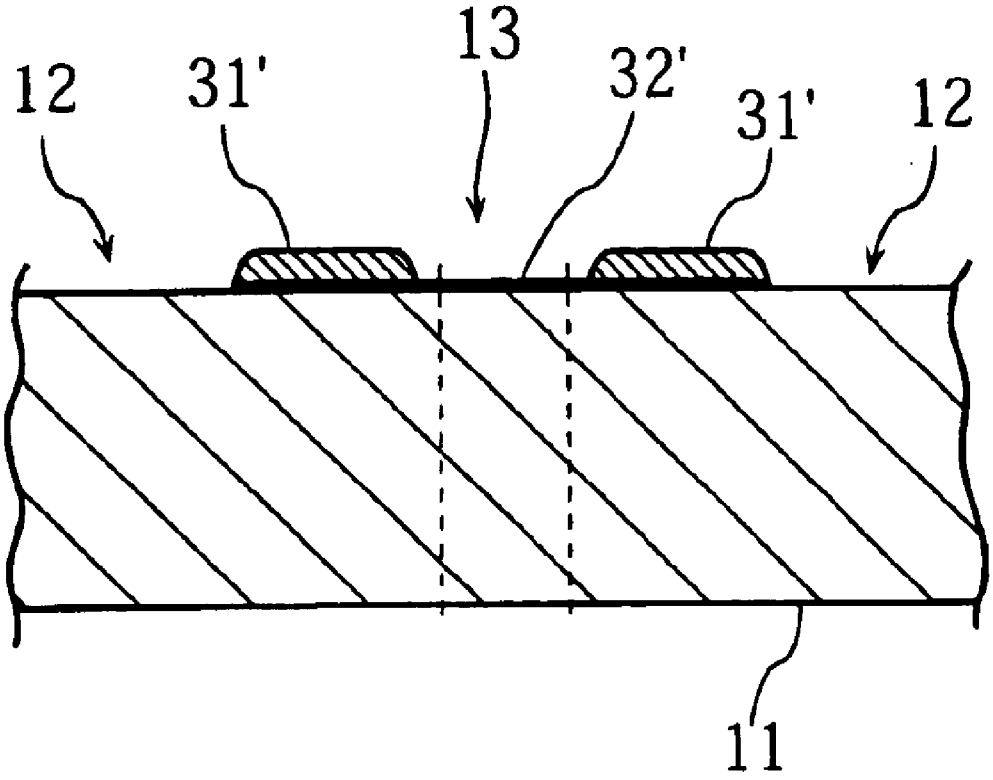

In the above embodiment, the thicker conductor layers 31' are formed after the formation of the thinner conductor layers 32'. However, this order may be reversed. Further, as shown in FIG. 5, the conductor layers 31' may be entirely formed on the conductor layers 32'.

Figure 6A:
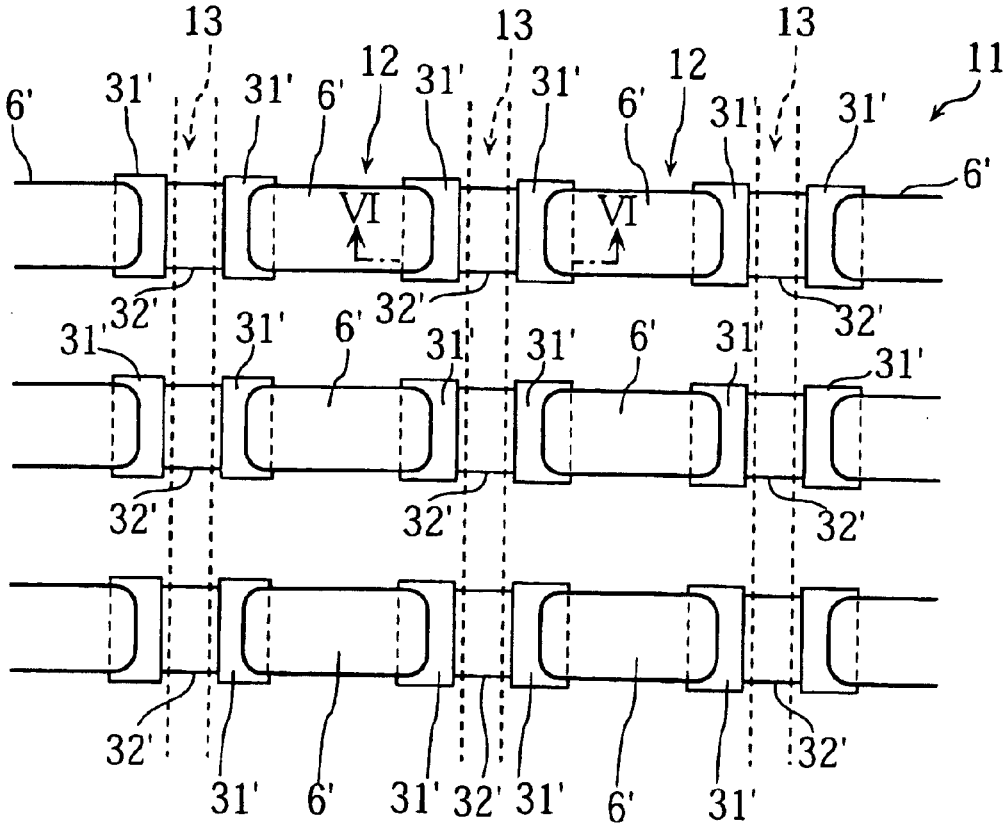
Figure 6B:
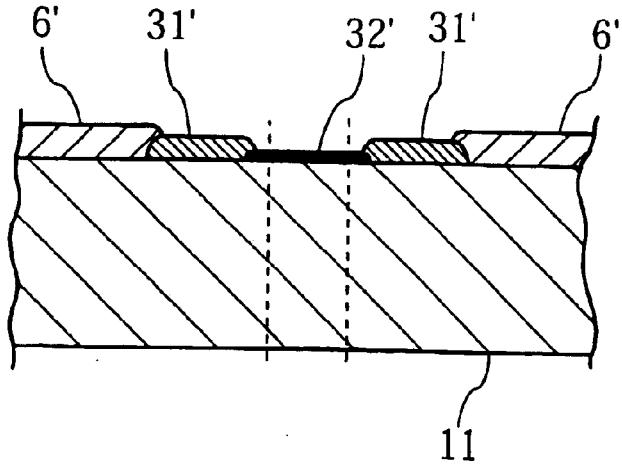
Figure 14:
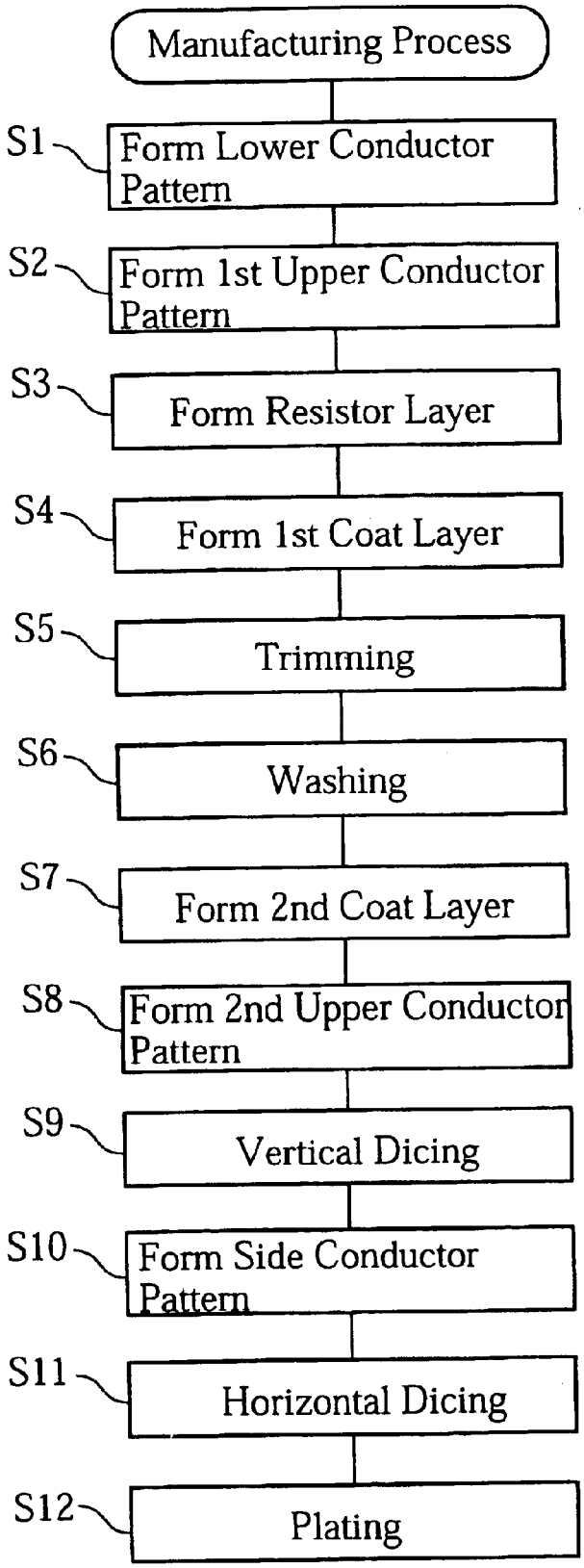
FIG. 14 is a flow chart of the manufacturing process.
Figure 15:
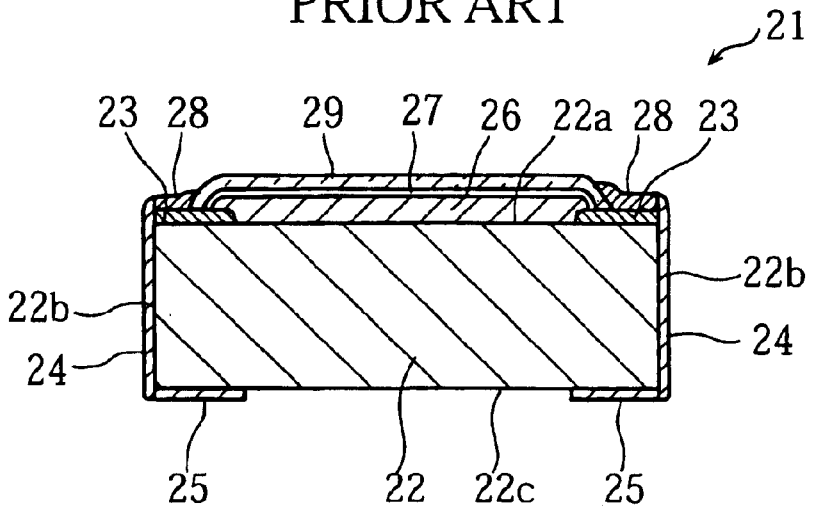
FIG.15 PRIOR ART
FIG. 15 is a sectional view illustrating the basic structure of a prior art chip resistor.
Figure 16:
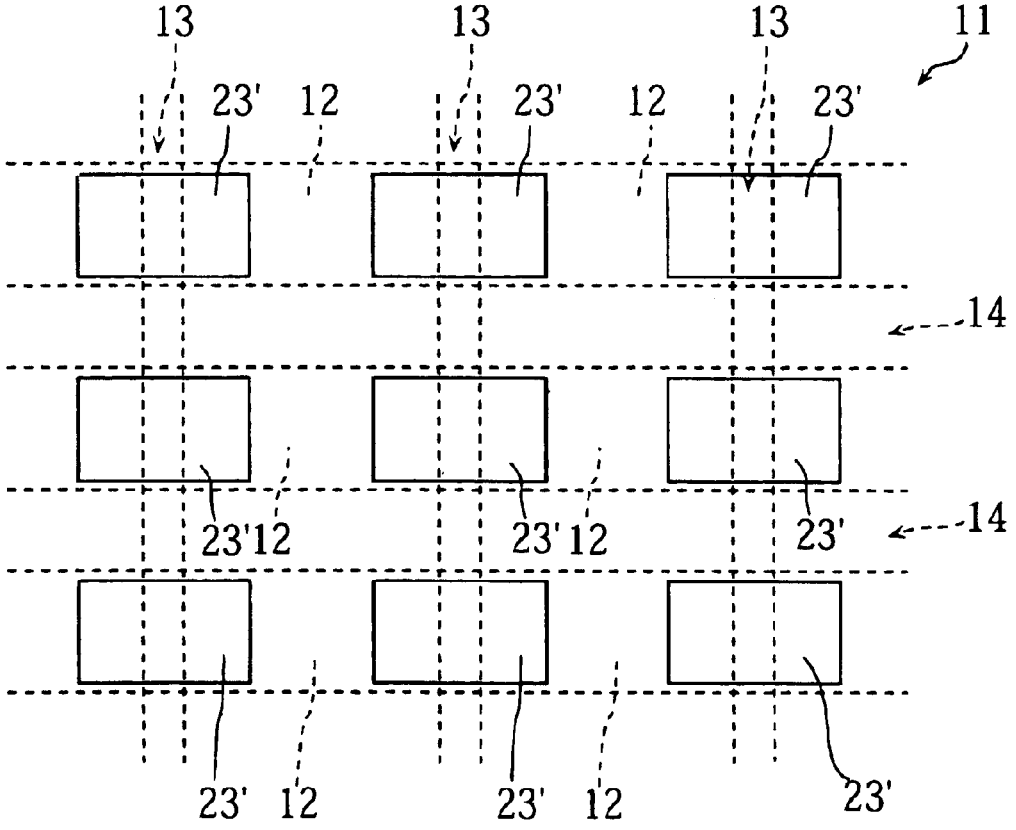
FIG.16 PRIOR ART
FIG. 16 is a plan view showing one process step in the manufacturing process of the chip resistor of FIG. 15.

After the formation of the first upper conductor pattern (conductor layers 31' and 32'), resistor layers 6' are formed for the rectangular regions 12, as shown in FIGS. 6A and 6B (S3 in FIG. 14). As shown in FIG. 6A, each resistor layer 6' extends to bridge two conductor layers 31' spaced from each other in a respective rectangular region 12. The resistor layer 6' may be formed by screen-printing resistor paste (consisting of a conductor component and glass frit) and baking the applied paste.

As described above, the conductor layers 31' have a relatively large thickness (5–25 $\mu$m). This thickness is determined so that the conductor layers 31' connected to the resistor layer 6' do not influence the electric resistance characteristics of the resistor layer 6'. Preferably, the thickness of the resistor layer 31' may be about 10 $\mu$m.

Subsequently, first coating layers 7' (See FIG. 8) are formed to entirely cover the resistor layers 6' (S4 in FIG. 14). The first coating layers 7' are formed by printing and baking an insulating paste containing a glass component.

Figure 7:
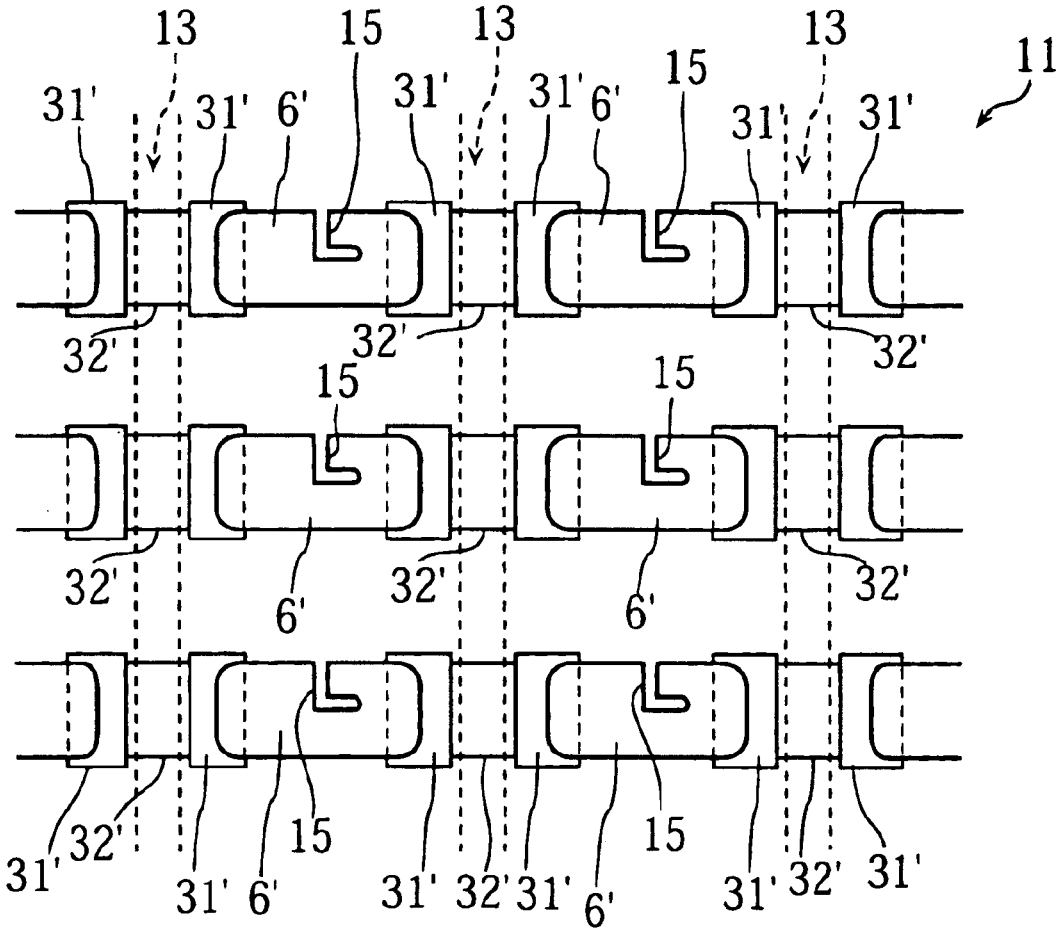

Then, as shown in FIG. 7, trimming is performed with respect to each of the resistor layers 6' for setting the resistance thereof to a predetermined value (S5 in FIG. 14). The trimming may be performed by laser beam application while monitoring the resistance of each resistance layer 6' by bringing measurement probes (not shown) into contact with the conductor layers 31' or 32'. As a result, a resistance adjusting groove 15 as shown in FIG. 7 is formed on each resistor layer 6' (and the first coating layer 7').

Figure 8:
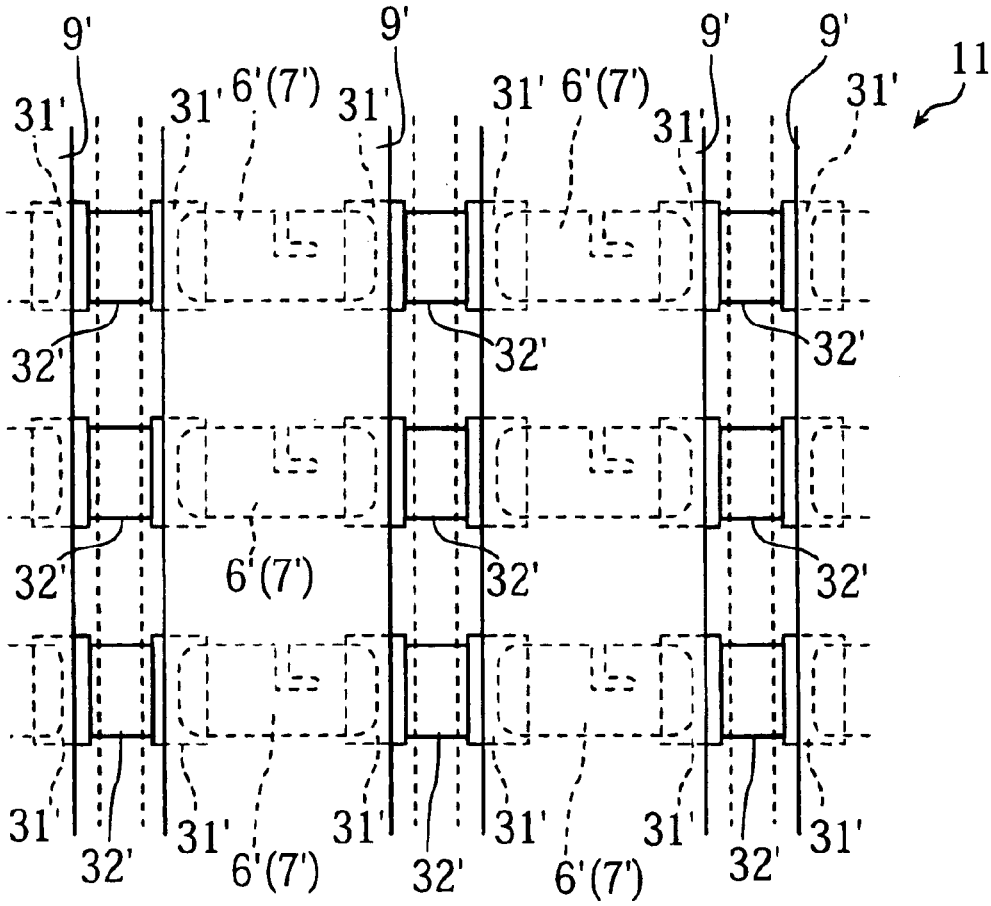

After the trimming, the entirety of the aggregate board 11 is cleaned (S6 in FIG. 14) to remove cuttings and the like generated by the trimming. Thereafter, as shown in FIG. 8, second coating layers 9' are formed (S7 in FIG. 14). Each of the second coating layers 9' extends vertically of the aggregate board 11 to entirely cover the first coating layers 7' arranged in that direction. The second coating layers 9' may be formed by baking an insulating paste applied by screen printing.

Figure 9:
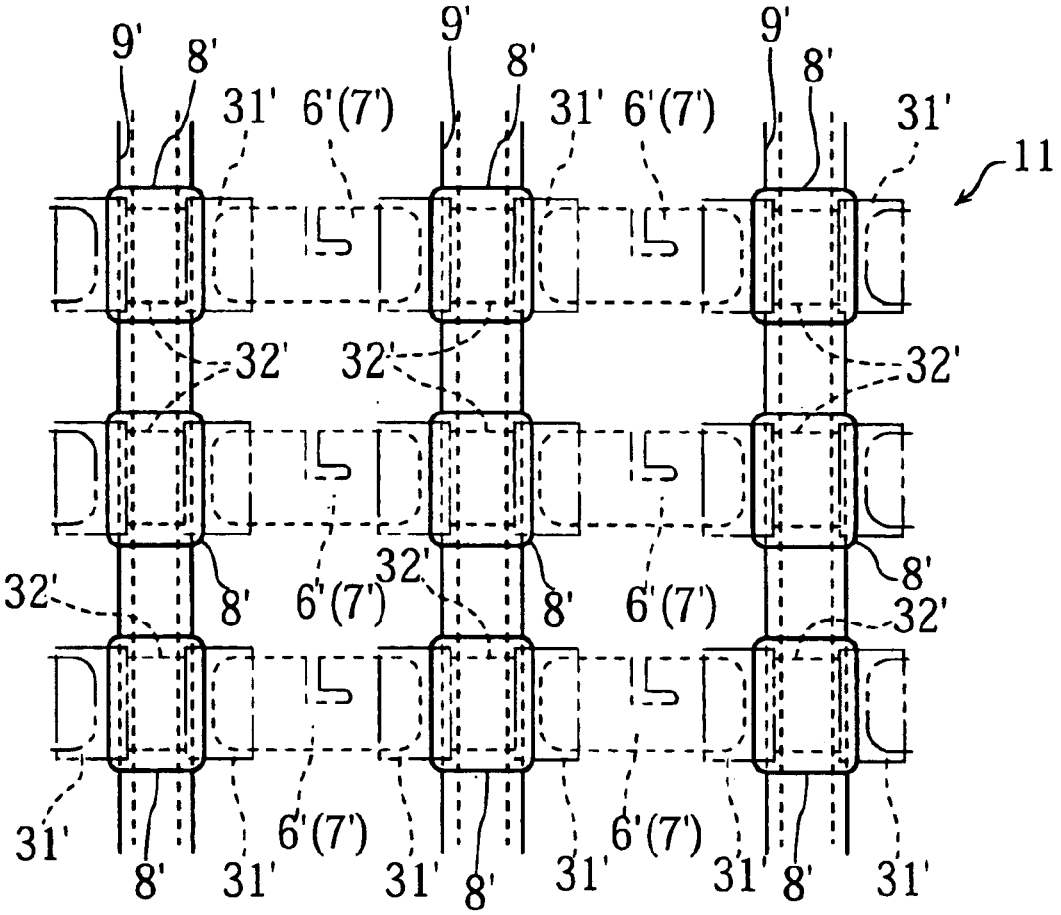
Figure 10:
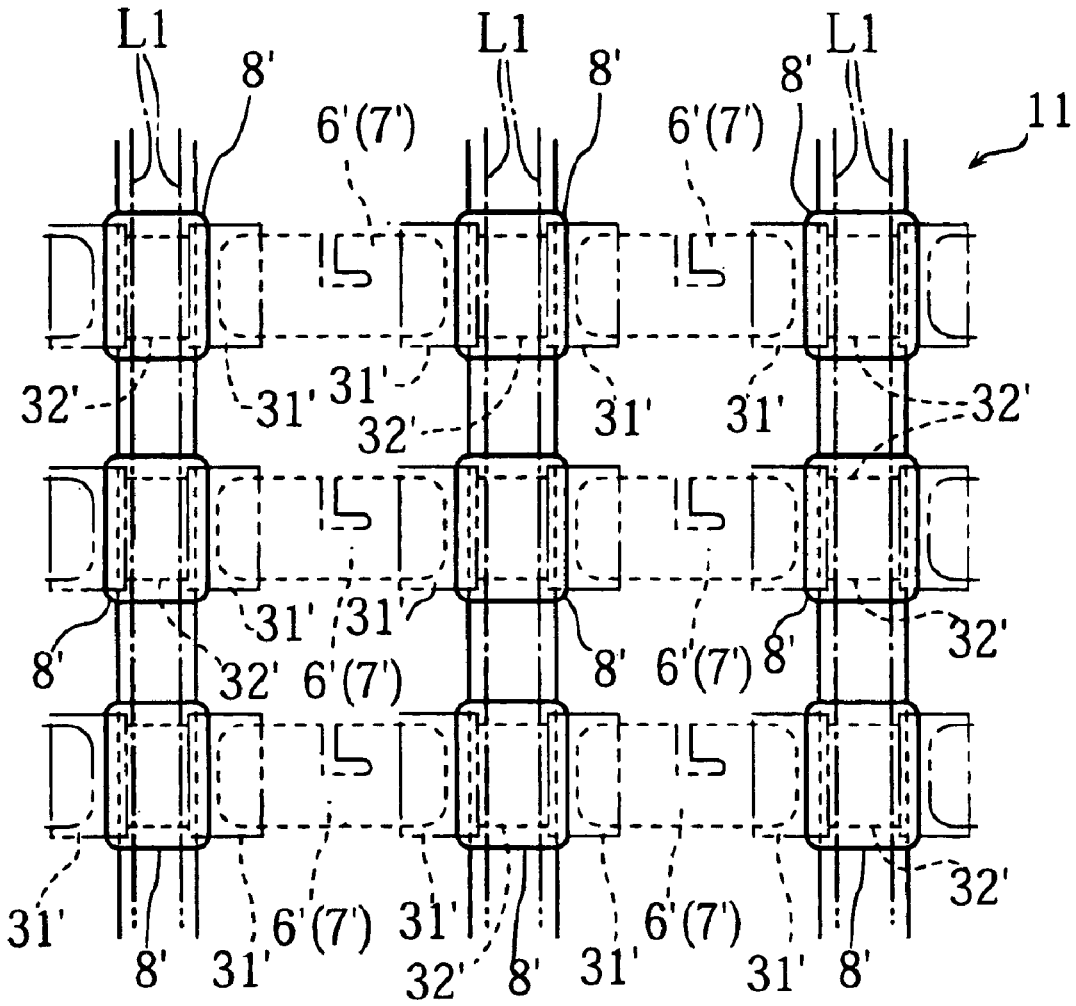

Then, as shown in FIG. 9, second upper conductor pattern 8' is formed (S8 in FIG. 14). The conductor pattern 8' comprises a plurality of rectangular conductor pieces, each of which extends to bridge two adjacent conductor layers 31' while traversing the cutting line 13. The second upper conductor pattern 8' may be formed by screen-printing a resinated silver paste. The resinated silver paste may be prepared by dispersing minute silver particles and glass particles in a resin.

Figure 11:
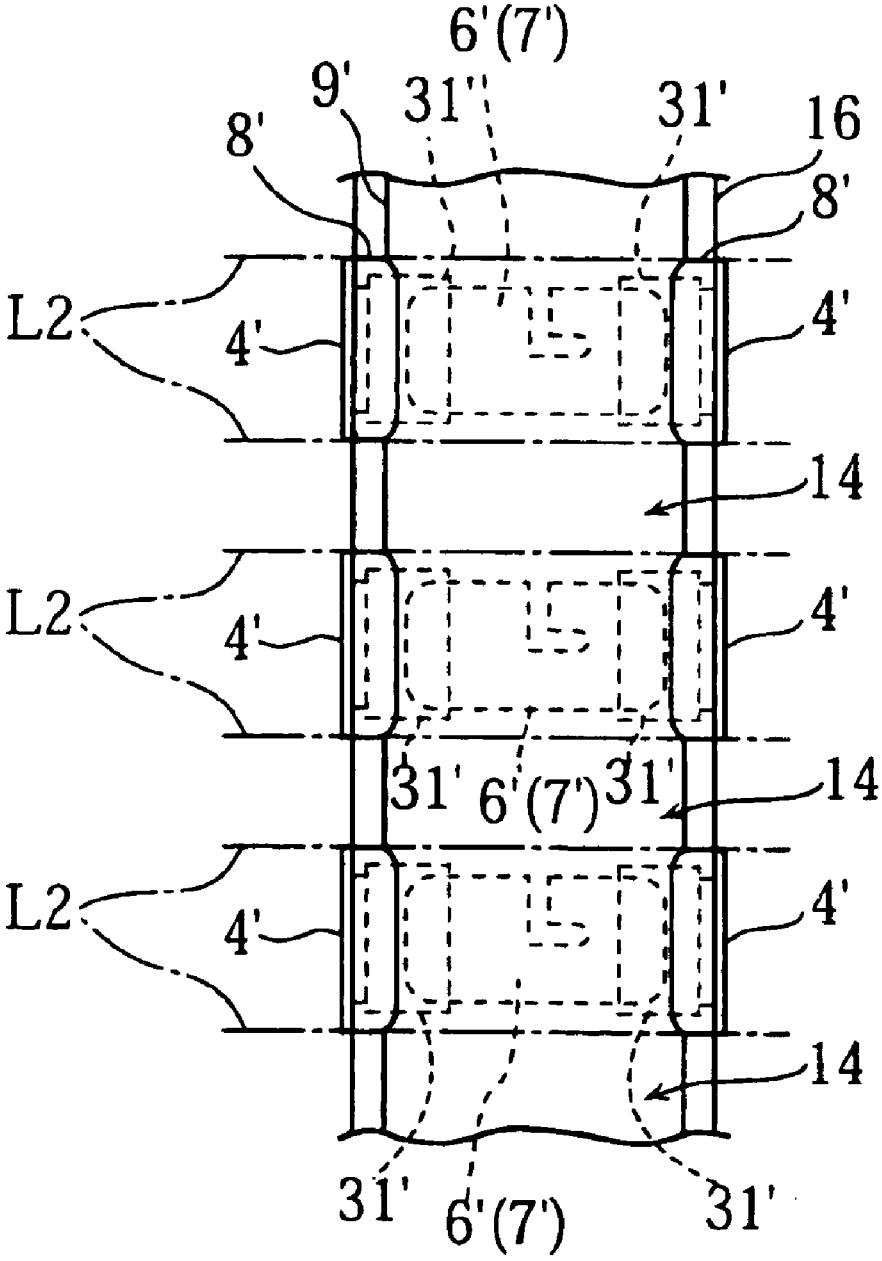
Figure 12:
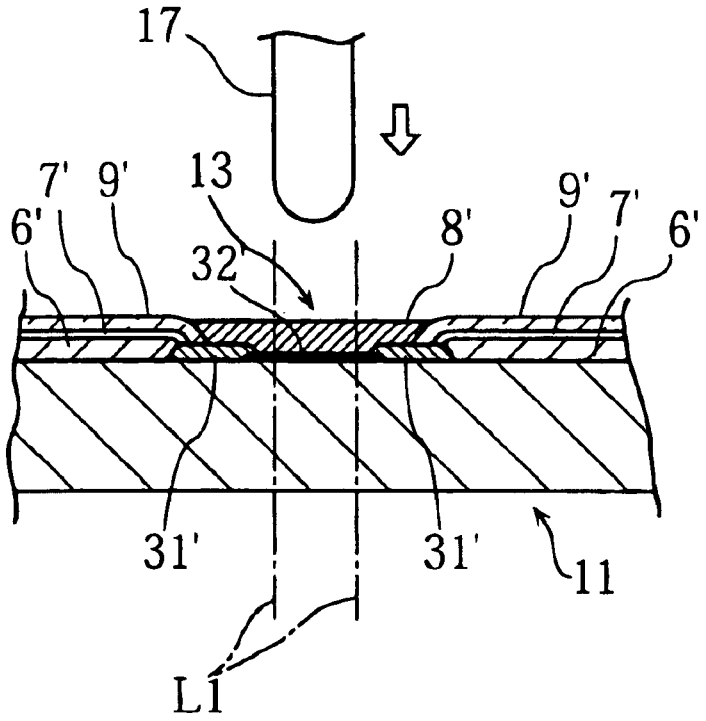
Figure 13:
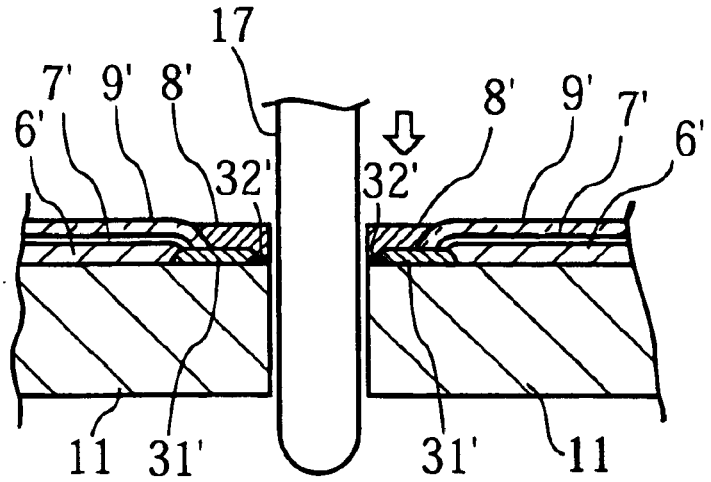

Subsequently, the aggregate board 11 is cut vertically (S9 in FIG. 14). Specifically, the aggregate board 11 is cut along lines L1 shown in FIG. 10. As a result, an intermediate product 16 is obtained, as shown in FIG. 11. As shown in FIGS. 12 and 13, the cutting may be performed using a dicing cutter provided with a blade 17 in the form of a circular plate which is driven for rotation. The blade 17 may be about 0.1 mm in width and about 50 mm in diameter for example.

Figure 17:
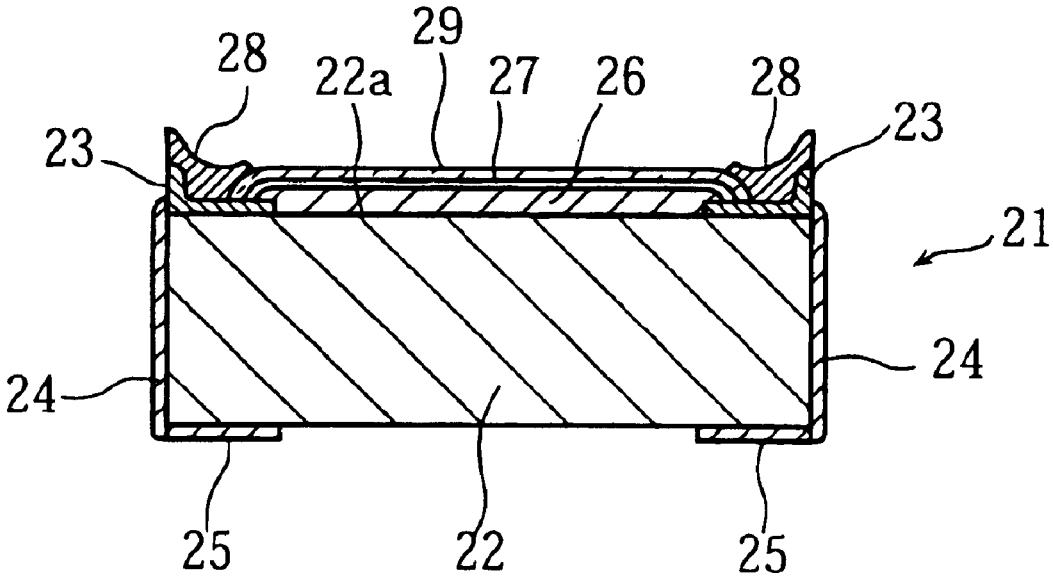
FIG.17 PRIOR ART
FIG. 17 illustrates a problem of the prior art chip resistor.

As described before, in the prior art manufacturing method, the rotation of the blade 17 caused the upper electrode 23 to rise at the cutting portion (FIG. 17). However, since the conductor layer 32' according to the above embodiment is small in thickness, such rising does not occur. Further, the second upper conductor pattern 8' is formed of resinated silver which has a small malleability. Therefore, the rising of the second upper conductor pattern 8' is also prevented.

Moreover, the inventor has experimentally found that the rising of the upper electrode 23 is prevented by adjusting the composition of the electrode-forming paste. Specifically, the rising of the upper electrode 23 is prevented by increasing the proportion of the glass component contained in the electrode-forming paste. However, attention should be paid because, when the proportion of the glass component is excessively increased, the conductance of the upper electrode 23 unduly decreases.

Subsequently, as shown in FIG. 11, side conductor patterns 4' are formed on respective opposite cut surfaces of the intermediate product 16 (S10 in FIG. 14). The side conductor pattern 4' is so formed as to be electrically connected to the first upper conductor pattern (31', 32') through the second upper conductor pattern 8'. Therefore, the side conductor pattern 4' extends up to the upper surface of the substrate 11 for reliable electrical connection to the second upper conductor pattern 8' (See FIG. 1).

Thereafter, the intermediate product 16 is cut horizontally along cutting lines L2 shown in FIG. 11 (S11 in FIG. 14). Subsequently, nickel-plating or solder-plating is applied to the exposed portions of the second upper conductor patterns 8', the side conductor patterns 4' and the lower conductor patterns (S12 in FIG. 14). In this way, the resistor 1 as shown in FIG. 1 is obtained.

According to the above process, the first upper electrode 3 and the second upper electrode 8 of the resistor 1 do not include any rising portion. Therefore, the resistor 1 according to the present invention does not suffer the problems described with respect to the prior art.

The present invention being thus described, it is apparent that the same may be varied in many ways. Such variations should not be regarded as a departure from the spirit and scope of the present invention, and all such modifications as would be obvious to those skilled in the art are intended to be included within the scope of the following claims.

What is claimed is:

1. A chip resistor comprising:

an insulating substrate having an upper surface and a side surface;

a first conductor pattern formed on the upper surface;

a resistor element connected to the first conductor pattern; and a protective coating covering the resistor element;

the first conductor pattern including a thinner-walled portion contacting the upper surface, and a thicker-walled portion connected to the thinner-walled portion and contacting the upper surface, the thinner-walled portion being spaced from the resistor element and extending up to the side surface, the thicker-walled portion contacting the resistor element and being spaced from the side surface;

the thinner-walled portion being positioned entirely outside the protective coating;

the thicker-walled portion being positioned partially outside the protective coating and partially inside the protective coating.

2. A chip resistor comprising:

an insulating substrate having an upper surface and a side surface;

a first conductor pattern formed on the upper surface;

a resistor element connected to the first conductor pattern; and a second conductor pattern extending on the first conductor pattern;

the first conductor pattern including a thinner-walled portion contacting the upper surface, and a thicker-walled portion connected to the thinner-walled portion and contacting the upper surface, the thinner-walled portion being spaced from the resistor element and extending up to the side surface, the thicker-walled portion contacting the resistor element and being spaced from the side surface;

the second conductor pattern contacting both of the thinner-walled portion and the thicker-walled portion.

3. A chip resistor comprising:

an insulating substrate having an upper surface and a side surface;

a first conductor pattern formed on the upper surface; and a resistor element connected to the first conductor pattern;

the first conductor pattern including a thinner-walled portion contacting the upper surface, and a thicker-walled portion connected to the thinner-walled portion and contacting the upper surface, the thinner-walled portion being spaced from the resistor element and extending up to the side surface, the thicker-walled portion contacting the resistor element and being spaced from the side surface;

wherein the thinner-walled portion has a thickness of 0.1–3.0 $\mu$m, whereas the thicker-walled portion has a thickness of 5–25 $\mu$m.

* * * * *